US006024148A

United States Patent [19]

Saitoh et al.

[11] Patent Number: 6,024,148

[45] **Date of Patent: *Feb. 15, 2000**

[54] ADHESIVE TAPE DISPENSING APPARATUS

[75] Inventors: Masayoshi Saitoh; Shigenobu Kushihashi; Shozo Horikawa, all of Tokyo, Japan

[73] Assignee: Japan Tobacco Inc., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/687,199

[22] Filed: Jul. 25, 1996

[30] Foreign Application Priority Data

Jul. 28, 1995 [JP] Japan ..... 7-193159

[51] Int. Cl.[7] ..... B32B 31/00

[52] U.S. Cl. ..... 156/361; 156/519; 156/541; 156/238; 156/265

[58] Field of Search ..... 156/519, 521, 156/361, 362, 265, 234, 248, 584, 257, 238, 541, 542, 267

[56] References Cited

U.S. PATENT DOCUMENTS

| | | | |
|---|---|---|---|
| 3,625,799 | 12/1971 | Way | 156/530 |
| 3,765,992 | 10/1973 | Stageberg | 156/521 |
| 4,328,062 | 5/1982 | Off et al. | 156/353 |
| 4,379,017 | 4/1983 | Barta | 156/238 |
| 4,459,170 | 7/1984 | Kerwin | 156/361 |
| 4,778,551 | 10/1988 | Coffman | 156/267 |
| 4,906,319 | 3/1990 | Fiorani | 156/355 |
| 5,232,539 | 8/1993 | Carpenter et al. | 156/360 |
| 5,556,492 | 9/1996 | Vonderhorst et al. | 156/64 |
| 5,607,539 | 3/1997 | Kuppersbusch | 156/364 |

FOREIGN PATENT DOCUMENTS

| | | | |
|---|---|---|---|
| 0539985 | 5/1993 | European Pat. Off. | B65H 19/18 |
| 5-123146 | 5/1993 | Japan | A24C 5/00 |

*Primary Examiner*—Richard Crispino
*Assistant Examiner*—Linda L Gray
*Attorney, Agent, or Firm*—Birch, Stewart, Kolasch & Birch, LLP

[57] ABSTRACT

An apparatus for sticking a double-sided adhesive tape in a predetermined position on a web, including an adhesive tape roll holding mechanism for tape roll, an adhesive tape delivery mechanism for delivering an adhesive tape laminate from the tape roll, and a pressing member for pressing the adhesive tape laminate against the web. The delivered adhesive tape laminate is held under pressure between the pressing member and the web, whereupon each of tape pieces on a seal of the laminate is stuck on the web.

13 Claims, 7 Drawing Sheets

ADHESIVE TAPE DISPENSING APPARATUS

BACKGROUND OF THE INVENTION

1. Field of the Invention

The present invention relates to an apparatus for dispensing an adhesive tape to be stuck on a web, such as cigarette paper or tip paper, which is used in manufacturing, for example, cigarettes, cigarette filters, etc., and more specifically, to an adhesive tape dispensing apparatus with improved reliability, used in an apparatus that separates a double-sided adhesive tape from one side of a seal and sticks it on the web.

2. Description of the Related Art

Conventionally, in manufacturing filter cigarettes, for example, webs, such as belt-shaped cigarette paper, tip paper, etc. are supplied in succession. Each web is provided in the form of a roll, and it is let out or delivered continuously from the roll. When this roll is exhausted, another roll is set in a delivery apparatus, and the leading end portion of a web from the new roll is connected to the trailing end portion of a web previously delivered from the first roll. In this manner, the web can be supplied to a cigarette manufacturing apparatus or the like without interruption.

In general, a double-sided adhesive tape is used to connect the webs. It is stuck on a belt-shaped seal to form an adhesive tape laminate as a whole. The laminate, including the seal, is cut into pieces of a predetermined length. One of the adhesive tape pieces is stuck on one of the webs, and the seal is separated thereafter. Then, the other web is put on the tape piece so that the two webs are connected by means of the double-sided adhesive tape piece.

Since the double-sided adhesive tape is sticky, however, the cut tape piece is not easy to handle, and it is difficult to automate adhesive tape supply in a web connecting apparatus.

Described in Jpn. Pat. Appln. No. 3-311391 is an adhesive tape dispensing apparatus, which can automatically supply an adhesive tape in connecting webs without involving the aforesaid problem. FIGS. 1 and 2 schematically show an arrangement of this apparatus.

In FIG. 1, numerals 1*a* and 1*b* denote, respectively, a previously delivered web and a new web that is to be connected to the trailing end portion of the web 1*a*. The web 1*a* is delivered from a roll and fed past a pressing/cutting mechanism 2. The mechanism 2 includes a pressing member 3, which cuts and presses the trailing end portion of the web 1*a*.

The new web 1*b* is drawn out from its roll by means of a draw-out mechanism (not shown), hangs plumb down, and is fed downward by means of a suction conveyor mechanism 4. The mechanism 4 includes an endless belt 5, which is formed of an air-permeable material, and is decompressed to a negative pressure inside. As the belt 5 travels, therefore, the web 1*b* is fed downward with its leading end portion attracted to the belt 5 by suction under the negative pressure.

An adhesive tape dispensing mechanism 6 is located in the vicinity of the suction conveyor mechanism 4. The mechanism 6 is provided with an adhesive tape roll 7 that is prepared by rolling an adhesive tape laminate 12. The laminate 12 delivered from the roll 7 is run past guide rollers 8 and 10 and a roller 9 and wound up on a tape reel 11. The adhesive tape laminate 12 is formed by sticking a double-sided adhesive tape 15 on one side of a belt-shaped seal 14, as shown in FIG. 2, and is delivered with the tape 15 outside the roller 9.

The adhesive tape dispensing mechanism 6 comprises an adhesive tape cutter mechanism 13. The mechanism 13 includes a cutting knife 16, which faces the tape-side surface of the delivered adhesive tape laminate 12 and is located so as to cross the laminate 12. The knife 16 is designed so that it can be pressed against the double-sided adhesive tape 15 under a predetermined pressure and reciprocated in the transverse direction of the laminate 12 or in the direction of the edge of the knife 16.

In the adhesive tape dispensing mechanism 6 arranged in this manner, the cutting knife 16 is pressed against the double-sided adhesive tape 15 and oscillated in the direction of its edge, whereupon only the tape 15 is cut to form a cut portion C, as shown in FIG. 2.

Subsequently, the whole adhesive tape dispensing mechanism 6 advances, and the double-sided adhesive tape 15 of the adhesive tape laminate 12, guided along the outer peripheral surface of the roller 9, is pressed against the leading end portion of a new web 1*b*. Then, the entire mechanism 6 moves down, whereupon the roller 9 rolls along the web 1*b*. As a result, a double-sided adhesive tape piece 15*a* of a predetermined length, obtained by cutting the laminate 12 guided along the outer peripheral surface of the roller 9, is stuck on the surface of the web 1*b* and separated from the seal 14.

Then, the web 1*b*, having the tape piece 15*a* stuck thereon, is moved downward by the suction conveyor mechanism 4, and is lapped on the trailing end portion with the previously fed web 1*a*. Thereupon, the pressing member 3 of the pressing/cutting mechanism 2 advances, thereby pressing the webs 1*a* and 1*b* so that the webs are connected by means of the tape piece 15*a* and cutting an odd end of the trailing end portion of the web 1*a*.

According to the adhesive tape dispensing mechanism 6 constructed in this manner, the tape piece 15*a* from the double-sided adhesive tape 15 can be automatically stuck on the web 1*b*, and the webs 1*a* and 1*b* can be automatically connected to each other.

However, the operation and construction of this adhesive tape dispensing mechanism are complicated. In this apparatus, the tape piece 15*a* is stuck on the web as the roller 9 rolls on the web. If the web is a highly flexible thin web, such as cigarette paper, therefore, it may possibly be dislocated or crumpled. The cigarette manufacturing apparatus, in particular, is a large-scale system that produces cigarettes in large quantities. In the case where the web connection is unsuccessful, it takes a lot of time to stop the whole apparatus, remove defective joints, and restart the operation, so that the operating efficiency of the apparatus is lowered. Accordingly, there has been a demand for an additional improvement in reliability of the adhesive tape dispensing mechanism of the type described above.

SUMMARY OF THE INVENTION

The present invention has been contrived in consideration of these circumstances, and its object is to provide an adhesive tape dispensing apparatus, which can automatically stick an adhesive tape on a web with high reliability, and also, can securely stick the adhesive tape on even a highly flexible thin web.

According to the present invention, there is provided an apparatus for automatically sticking tape pieces of a predetermined length, obtained by cutting a double-sided adhesive tape, on a web. The apparatus comprises a body, an adhesive tape roll prepared by rolling an adhesive tape laminate formed of a seal and the double-sided adhesive tape put on one side of the seal, and an adhesive tape roll holding mechanism for holding the adhesive tape roll. The apparatus further comprises an adhesive tape delivery/guide mechanism for delivering the adhesive tape laminate from the adhesive tape roll and guiding the double-sided adhesive tape opposite the web, a pressing member located on the seal side of the delivered adhesive tape laminate, and a pressing mechanism for moving the pressing member toward the web to press the tape pieces from the double-sided adhesive tape against the web, thereby sticking the tape pieces on the web.

According to the apparatus of the invention arranged in this manner, the adhesive tape laminate is pressed against the web by the pressing mechanism, whereupon the tape pieces from the double-sided adhesive tape are stuck on the web and separated from the seal. In this manner, the tape pieces can be automatically stuck on the web. Since the tape pieces are stuck on the web by being pressed by the pressing member, moreover, even a highly flexible thin web cannot be dislocated or crumpled. Thus, the apparatus enjoys a simple construction with high reliability.

Preferably, the adhesive tape laminate is formed of the belt-shaped seal and a continuous belt-shaped double-sided adhesive tape put on the one side of the seal, and the apparatus further comprises a double-sided adhesive tape cutter mechanism including a cutting knife adapted to be pressed against the adhesive tape of the laminate under a predetermined pressure so as to extend in the transverse direction of the adhesive tape and to be reciprocated in the direction of the edge thereof to cut only the adhesive tape, thereby forming the tape pieces of the predetermined length.

According to this arrangement, a ready-made continuous adhesive tape may be used for the adhesive tape laminate, and the length of each tape piece may be changed as required.

Preferably, moreover, the adhesive tape laminate is formed of the belt-shaped seal and a plurality of precut belt-shaped double-sided adhesive tape pieces of the predetermined length stuck on the seal, and the apparatus further comprises a tape piece position detecting mechanism for detecting the position of each tape piece, thereby controlling the adhesive tape delivery of the adhesive tape delivery/guide mechanism and locating each tape piece in a predetermined position corresponding to the pressing member.

According to this arrangement, the double-sided adhesive tape is previously cut into the tape pieces of the predetermined length, so that it can be securely stuck on the web with a simple construction.

Preferably, furthermore, the pressing mechanism sticks the tape pieces on the web in a manner such that the apparatus body is moved toward the web and that the pressing member is moved toward the web with respect to the body, thereby pressing the adhesive tape laminate against the web.

In this arrangement, the body is moved toward the web, and the pressing member is moved toward the web with respect to the body, so that the tape pieces can be securely stuck on the web by pressing the adhesive tape laminate against the web by means of the pressing member.

Preferably, moreover, the adhesive tape delivery/guide mechanism includes a pair of pinch rollers arranged so that only the seal is fed under pressure between the pinch rollers after the tape pieces are stuck on the web, whereby the adhesive tape laminate is delivered from the adhesive tape roll.

In this arrangement, only the seal is fed under pressure between the pinch rollers after the tape pieces are stuck on the web, so that the adhesive tape laminate can be accurately fed having a constant length even though the diameter of the adhesive tape roll changes.

Preferably, moreover, the apparatus further comprises a scraper adapted to engage the surface of the seal after the tape pieces are stuck on the web, thereby removing an adhesive mass remaining on the seal surface.

With this arrangement, the residual adhesive mass can be prevented from adhering to the pinch rollers and the like and causing their erroneous operation.

Preferably, furthermore, the adhesive tape laminate in the adhesive tape roll is rolled so that the seal is situated outside, and the adhesive tape delivery/guide mechanism includes a guide roller for guiding the adhesive tape laminate from the adhesive tape roll for reversal so that the double-sided adhesive tape is situated outside.

According to this arrangement, the outer peripheral surface of the adhesive tape roll is always covered by the seal, and the double-sided adhesive tape is not exposed. Thus, the adhesive tape is protected against dust and other deteriorative factors.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
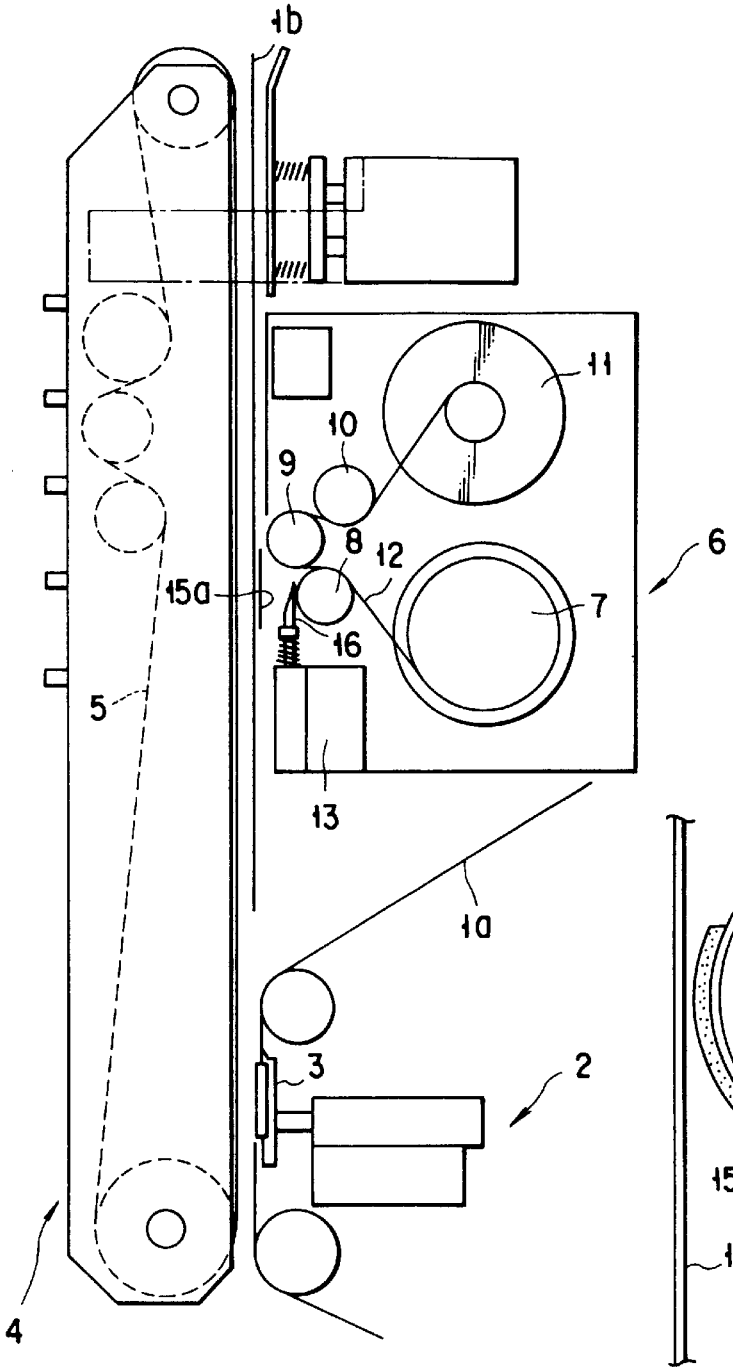
FIG. 1 (PRIOR ART)
FIG. 1 is a schematic side view of a conventional web apparatus.
Figure 2:
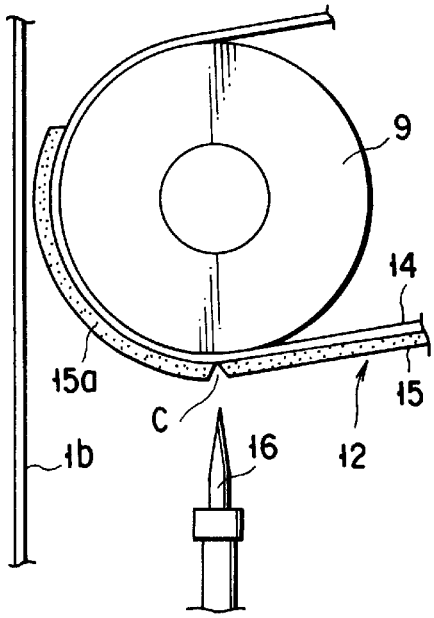
FIG. 2 (PRIOR ART)
FIG. 2 is a schematic side view of an adhesive tape dispensing mechanism of the conventional web connecting apparatus.
Figure 3:
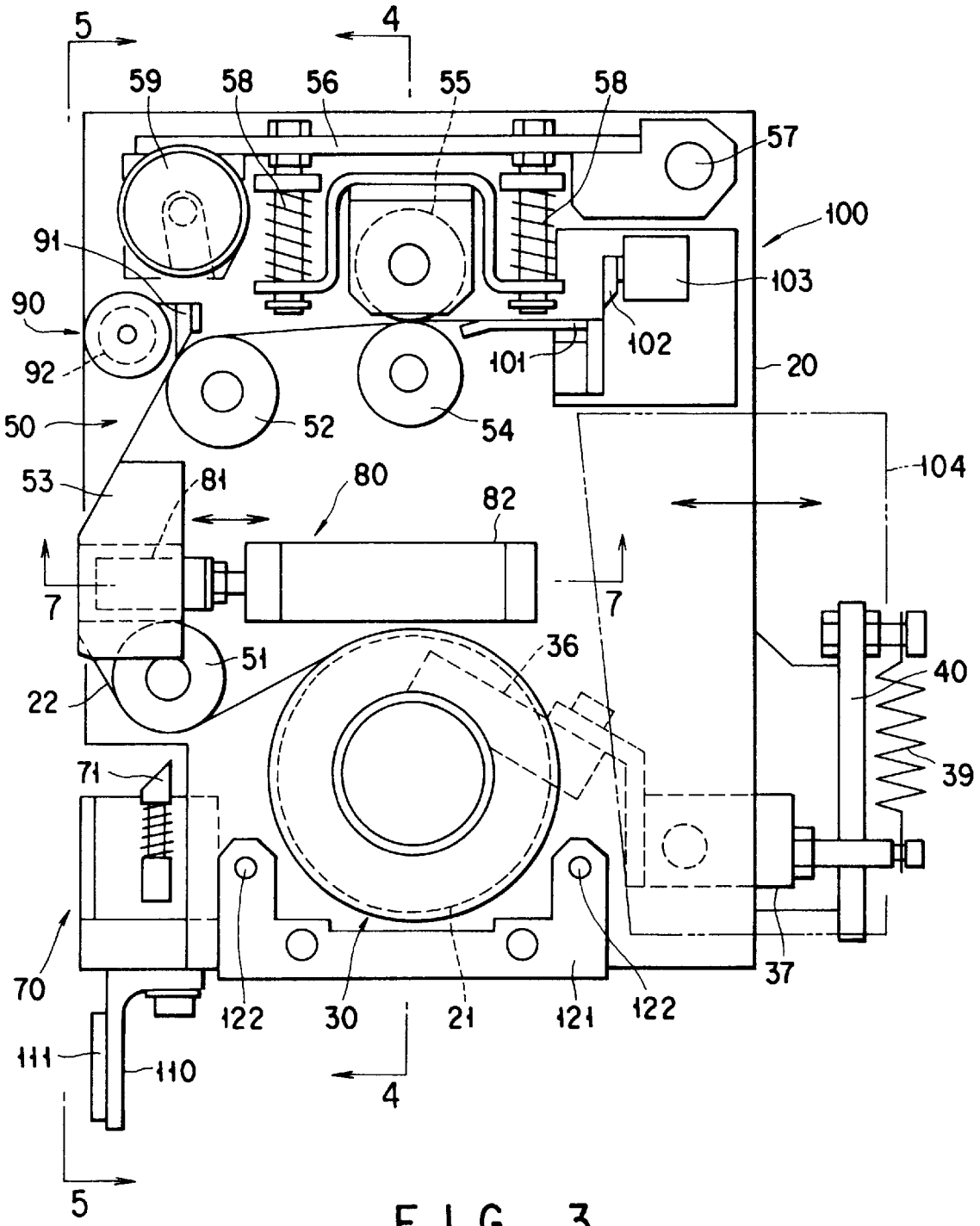
FIG. 3 is a side view of an adhesive tape dispensing apparatus according to a first embodiment of the present invention.

Referring now to FIGS. 3 to 8, a first embodiment of the present invention will be described. An adhesive tape dispensing apparatus according to this embodiment is an apparatus for supplying a cigarette manufacturing apparatus with a web, such as cigarette paper or tip paper. In this apparatus, each of double-sided adhesive tape pieces is automatically stuck on the web in order to connect the leading end portion of a new web to the trailing end portion of the previously delivered web. According to this embodiment, a web end connecting apparatus is generally constructed in the same manner as the conventional one shown in FIG. 1.

In the drawings, numeral 20 denotes a body of the adhesive tape dispensing apparatus according to the invention, which is attached to the connecting apparatus described above. The apparatus body 20 is located in the vicinity of a running web 1*b*. The body 20 is reciprocated toward and away from the web 1*b* by a guide mechanism and a drive mechanism. The whole adhesive tape dispensing apparatus, including the body 20, moves toward and away from the web 1*b*. The guide and drive mechanisms are conventional mechanisms, such as guide rails, air cylinder, etc., and illustration and a detailed description of those mechanisms are omitted.

Figure 8:
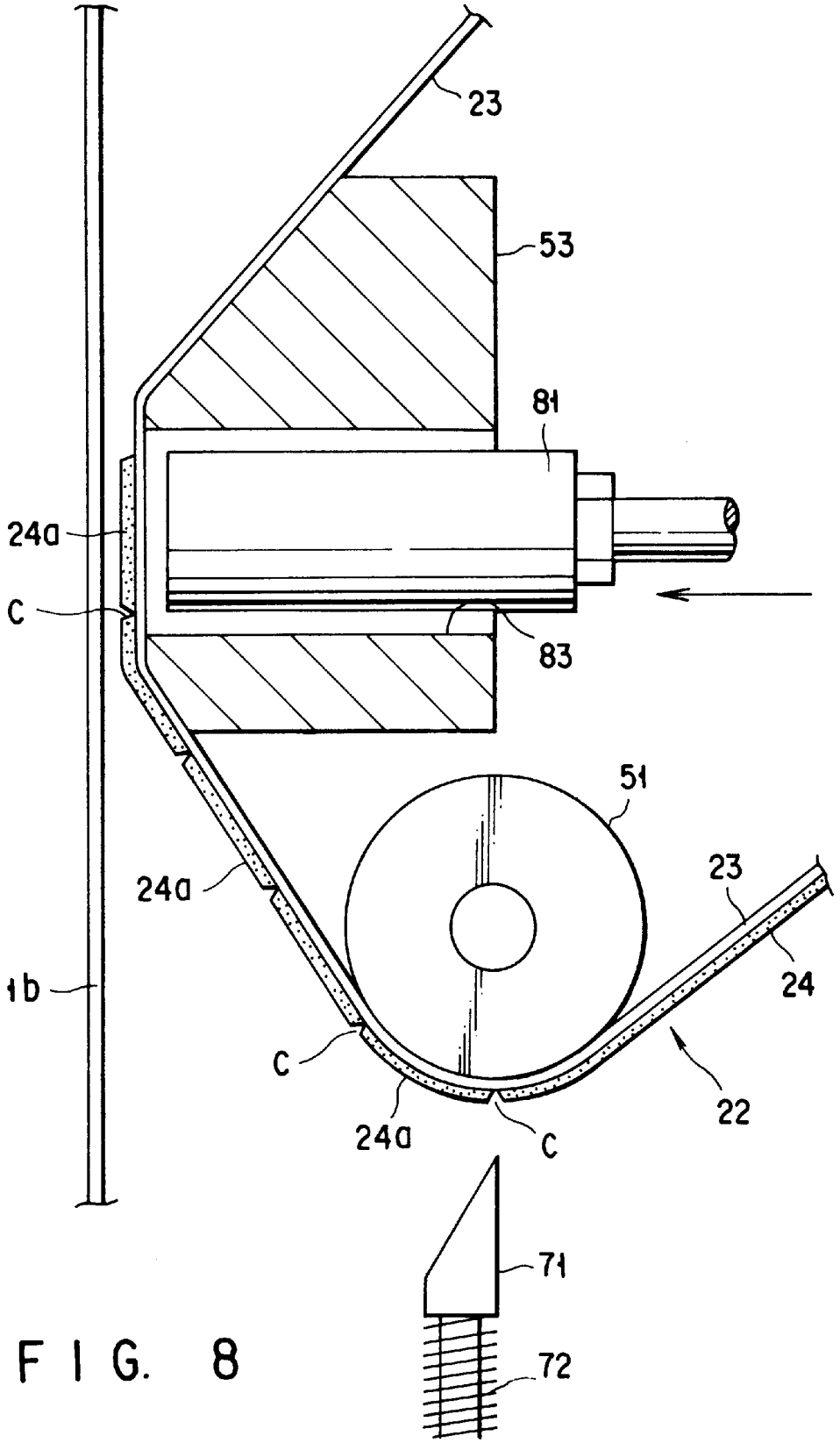
FIG. 8 is a vertical sectional view showing a guide block and a pressing member according to the first embodiment.

The body 20 is loaded with an adhesive tape roll 21. The roll 21 is wound with an adhesive tape laminate 22. As shown in FIG. 8, the laminate 22 is formed of a belt-shaped seal 23 and a continuous belt-shaped double-sided adhesive tape 24 put on one side of the seal 23. The tape 24 is bonded softly to the seal 23 so that it can be easily separated from the seal.

The adhesive tape laminate 22 is wound on the adhesive tape roll 21 in a manner such that its seal 23 is on the outer surface side. When the laminate 22 is on the roll 21, therefore, its double-sided adhesive tape 24 is not exposed, so that it is protected against dust or the like, and an adhesive mass on the tape 24 is prevented from deteriorating.

Figure 4:
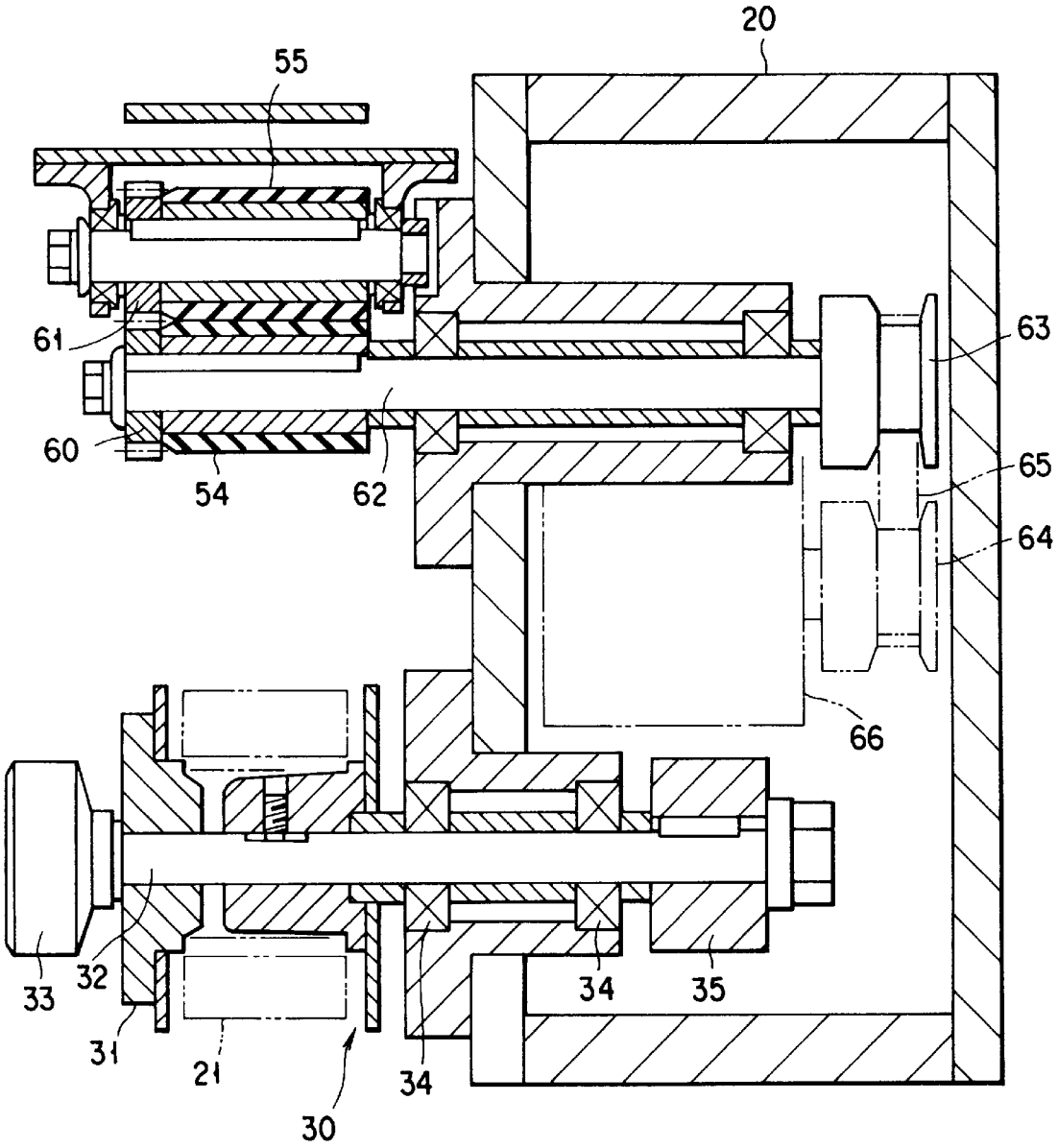
FIG. 4 is a sectional view taken along line 4—4 of FIG. 3.
Figure 5:
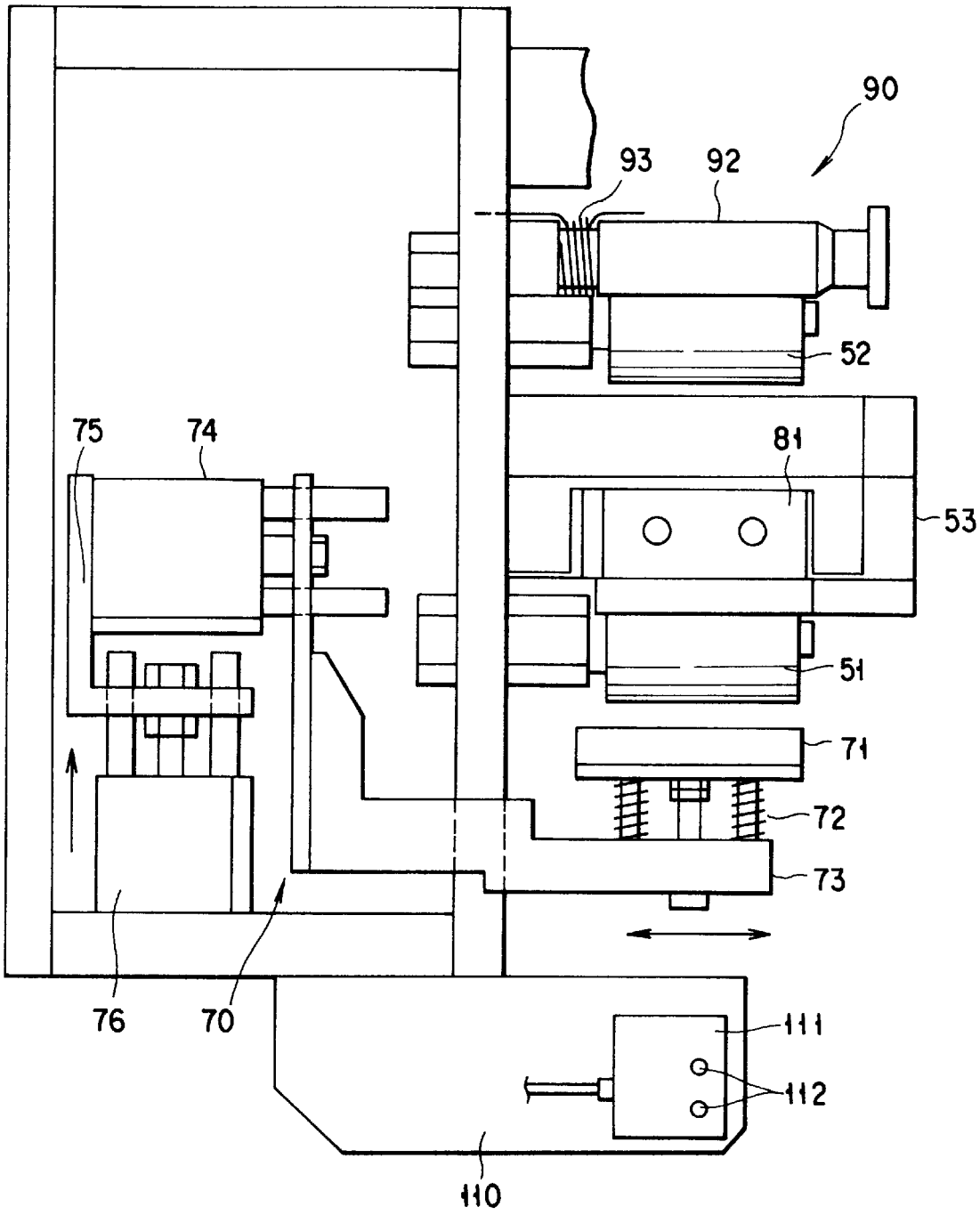
FIG. 5 is a view taken in the direction of the arrows along line 5—5 of FIG. 3.
Figure 6:
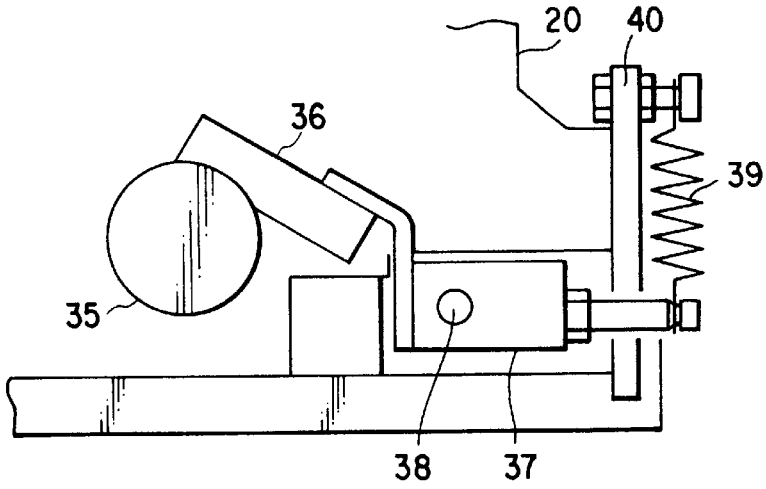
FIG. 6 is a side view of a brake system for a tape reel according to the first embodiment.
Figure 7:
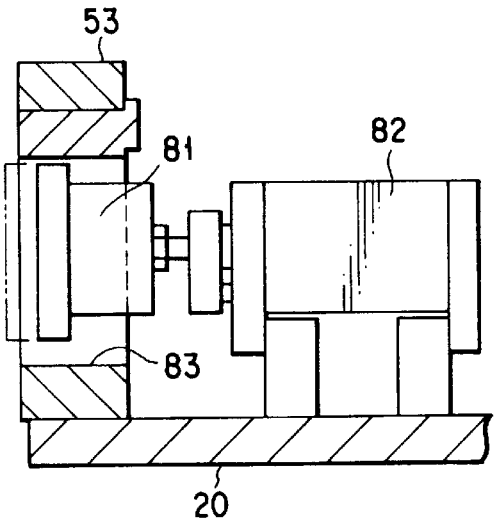
FIG. 7 is a sectional view taken along line 7—7 of FIG. 3.

The adhesive tape roll 21 is held for rotation by means of an adhesive tape roll holding mechanism 30, which is constructed in the manner shown in FIGS. 4 and 6. The mechanism 30 includes a tape reel 31, which is mounted on a reel shaft 32 and can be divided in the axial direction. The reel 31 is fixed by means of a knob 33 that is screwed on the shaft 32. In attaching or detaching the adhesive tape roll 21, the tape reel 31 is divided by removing the knob 33.

The reel shaft 32 is rotatably supported on the body 20 by means of a bearing 34. A brake drum 35 is attached to the rear end portion of the shaft 32, and a brake shoe 36 is pressed against the drum 35. The shoe 36 is attached to the distal end portion of an arm member 37, which is rockably mounted on a shaft 38 on the body 20. A tension coil spring 39 is stretched between an adjusting member 40, which is mounted on the body 20, and the rear end portion of the arm member 37. The brake shoe 36 is pressed against the brake drum 35 under a predetermined pressure by means of the urging force of the spring 39. The force of pressure of the brake shoe 36 can be adjusted by moving the adjusting member 40.

With use of the brake system constructed in this manner, the adhesive tape roll 21, which is held by the adhesive tape roll holding mechanism 30, is subjected to a predetermined rotational resistance as the adhesive tape laminate 22 is delivered from the roll 21, and a predetermined tension is applied to the laminate 22 being delivered in this manner.

Further, the body 20 is provided with an adhesive tape delivery/guide mechanism 50, which guides the running adhesive tape laminate 22 delivered from the adhesive tape roll 21. The mechanism 50 includes guide rollers 51 and 52 and a guide block 53. The laminate 22 delivered from the tape roll 21 is guided along a given path by the elements 51, 52 and 53, and is fed for a predetermined distance at a time by means of a pair of pinch rollers 54 and 55.

The adhesive tape laminate 22 delivered from the adhesive tape roll 21 is reversed guided by the guide roller 51, which is in rolling contact with the seal-side surface of the laminate 22, so that the tape-side surface turns outward or faces the web 1*b*, as shown in FIG. 8. Then, the seal side of the laminate 22 is guided in sliding contact with the guide block 53 in a manner such that the double-sided adhesive tape 24 faces the web 1*b* and is moved parallel to the web in this section. Further, the adhesive tape laminate 22 is guided by the guide roller 52.

The one pinch roller 55, out of the pair of rollers 54 and 55, is supported on a rocking arm 56 by means of springs 58. One end portion of the arm 56 is rockably mounted on a shaft 57 on the body 20, while the other end portion thereof is fixed in an optional position by means of a knob 59, which is screwed to the body 20. The pinch roller 55 is pressed against the other pinch roller 54 by means of the urging force of the spring 58. This urging force can be adjusted by loosening the knob 59 to rock the arm 56, thereby changing the depth of compression of the spring 58.

A rotating shaft 62 of the pinch roller 54 is connected to a stepping motor 66 by means of pulleys 63 and 64 and a toothed belt 65, and is accurately rotated step by step by the motor 66. Accordingly, the adhesive tape laminate 22, nipped between the pinch rollers 54 and 55, is accurately fed for the predetermined distance at a time. The outer peripheral surface of each pinch roller is covered by rubber, which increases the coefficient of friction of the roller. The pinch rollers 54 and 55 are rotated synchronously in opposite directions by means of a pair of gears 60 and 61, respectively.

A double-sided adhesive tape cutter mechanism 70 is provided on the upstream side of the guide block 53 with respect to the traveling direction of the adhesive tape laminate 22. The mechanism 70 includes a cutting knife 71, which is located so as to cross the delivered adhesive tape laminate 22 at right angles. The knife 71 is attached to an arm 73 by means of a spring 72, and the arm 73 is connected to an oscillation actuator 74. The actuator 74 serves to reciprocate the arm 73 and the cutting knife 71 in the transverse direction of the laminate 22 or along the edge of the knife 71.

The oscillation actuator 74 is attached to a holder 75, which is connected to a pressing cylinder 76. The cylinder 76 is designed so as to bring the actuator 74, arm 73, and cutting knife 71 close to the adhesive tape laminate 22 and press the knife 71 against the double-sided adhesive tape 24 of the laminate 22.

In the double-sided adhesive tape cutter mechanism 70 constructed in this manner, the cutting knife 71 is pressed against the double-sided adhesive tape 24 of the delivered adhesive tape laminate 22 by the pressing cylinder 76. Since the knife 71 is attached to the arm 73 by means of the spring 72, in this case, it is pressed against the tape 24 under a pressure corresponding to the urging force of the spring 72. Then, the knife 71 is reciprocated in the transverse direction of the laminate 22 or along the edge of the knife by the oscillation actuator 74. Thereupon, cut portions C are formed in the double-sided adhesive tape 24, as shown in FIG. 8. The cut portions C define tape pieces 24*a* of a predetermined length. Since the cutting knife 71 is softly pressed against the double-sided adhesive tape 24 under a predetermined pressure by means of the urging force of the spring 72, as mentioned before, only the tape 24 is cut with the seal 23 left uncut, as shown in FIG. 8. The cut tape pieces 24*a* are run together with the seal 23 without being separated from the seal.

The cut tape pieces 24*a* are stuck on the web 1*b* by means of a pressing mechanism 80. The mechanism 80 includes the aforesaid guide block 53. The adhesive tape laminate 22 reversed by the guide roller 51 is guided in a manner such that its seal 23 is in sliding contact with the guide block 53 and that its double-sided adhesive tape 24 faces the web 1*b*.

The central portion of the guide block 53 is penetrated by a through hole 83, which extends at right angles to the adhesive tape laminate 22 guided in the aforesaid manner. A pressing member 81 is inserted in the hole 83 so that it can advance and retreat or move toward and away from the web 1*b*. The member 81 is located on the seal side of the laminate 22 so that the laminate 22 is interposed between the member 81 and the web 1*b*. Further, the pressing member 81 is connected to a cylinder 82 that is mounted on the body 20. The cylinder 82 causes the pressing member 81 to advance or retreat with respect to the guide block 53 and the web 1*b*. In this embodiment, moreover, the body 20 is guided by means of a guide member (not shown) or the like so that it can advance or retreat with respect to the whole web connecting apparatus. Also, the body 20 or the whole adhesive tape dispensing apparatus is caused to advance or retreat by a cylinder (not shown) or the like.

When the web 1*b* stops at a predetermined position, the whole adhesive tape dispensing apparatus, including the body 20, advances toward the web 1*b*, and the pressing member 81 is caused to advance with respect to the body 20 by the cylinder 82. Thereupon, the adhesive tape laminate 22 is pressed against the web 1*b* from its seal side, whereby one of the tape pieces 24*a* is stuck on the web 1*b*.

According to this embodiment, in this case, the whole adhesive tape dispensing apparatus, including the body 20, advances toward the web 1*b*, and the pressing member 81 advances with respect to the body 20 so that it projects from the front end face of the guide block 53, thereby pressing the adhesive tape laminate 22 against the web 1*b* from the seal side. Thus, each tape piece 24*a* can be securely stuck on the web 1*b*.

The apparatus of the present invention is not limited to the arrangement described above, and may be designed so that the pressing member 81 is mounted integrally with the body 20, for example, and that the adhesive tape laminate is pressed against the web by means of the pressing member by advancing the body 20.

When the body 20 and the pressing member 81 is retreated or moved away from the web 1*b*, the double-sided adhesive tape 24 stuck on the web 1*b* is separated from the seal 23 to leave the seal alone, as shown in FIG. 8. Then, the seal 23 is guided by the guide roller 52 and fed for the predetermined distance at a time by the pinch rollers 54 and 55.

A scraper mechanism 90 is located in the vicinity the guide roller 52. The mechanism 90 includes a wedge-shaped scraper 91 mounted on a rocking member 92, which protrudes from the body 20 for rocking motion. The rocking member 92 is urged to rock in the clockwise direction of FIG. 3 by a torsion spring 93. Thus, the edge portion of the scraper 91 is pressed, under a predetermined pressure, against the one side of the seal 23 being guided by the guide roller 52.

As the seal 23 travels after one of the tape pieces 24*a* is separated therefrom, the scraper 91 of the scraper mechanism 90 removes any the adhesive mass remaining on the surface of the seal 23. Accordingly, there is no possibility of any residual adhesive mass causing the seal 23 to wind around the pinch rollers 54 and 55, so that the seal 23 can be run securely.

A cutting mechanism 100 is located behind the pinch rollers 54 and 55. The mechanism 100 includes a cutting stage 101 and a cutting knife 102. The knife 102 is actuated by a drive mechanism 103. A container 104 underlies the stage 101.

The seal 23 of the adhesive tape laminate 22, fed by the pinch rollers 54 and 55, is cut into short pieces by the cutting mechanism 100, and the pieces fall into the container 104 to be collected therein. After the double-sided adhesive tape is separated, therefore, the seal 23 need not be wound up. Thus, the seal 23 can be easily disposed of with use of a simple construction.

A detector mounting member 110 is provided at the lower part of the body 20, and a detector 111 is attached to the mounting member 110. The detector 111 includes a photosensor 112, which detects the arrival of the leading end portion of the web 1*b* at a predetermined position and outputs a detection signal. In response to this detection signal, the web 1*b* is stopped, and the adhesive tape dispensing apparatus is actuated.

An adhesive tape roll detector 121 is provided under the tape reel 31. The detector 121 includes a pair of photosensors 122. As the adhesive tape roll 21 intercepts light transferred between the photosensors 122, its diameter is detected. Alternatively, the optical detector may be formed of a reflector-type photosensor that detects the diameter of the adhesive tape roll by measuring the distance between itself and the outer periphery of the roll. When the roll diameter becomes smaller than a predetermined value as the adhesive tape laminate 22 of the tape roll 21 is consumed, the photosensors 122 output a signal to that effect and give an alarm indicative of the critical reduction of the residual volume of the laminate 22.

Figure 10:
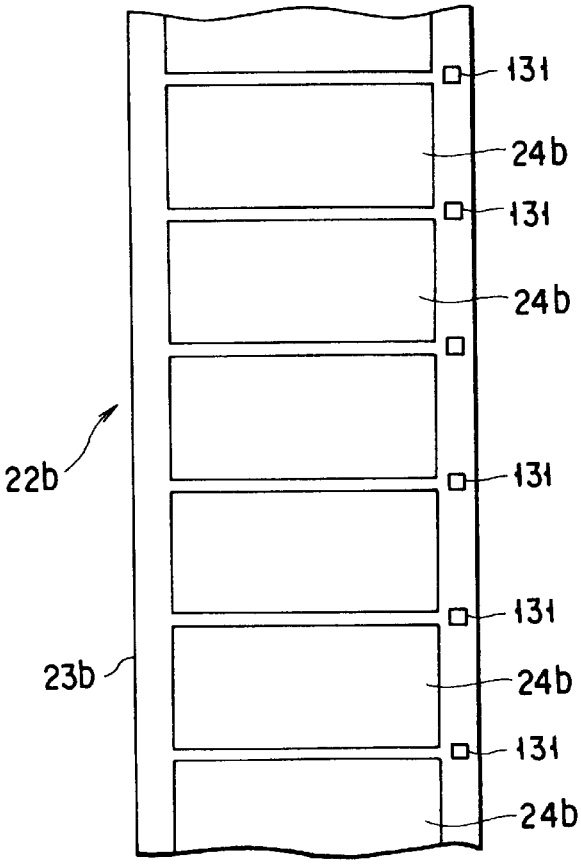
FIG. 10 is a plan view showing part of an adhesive tape laminate according to the second embodiment.
Figure 9:
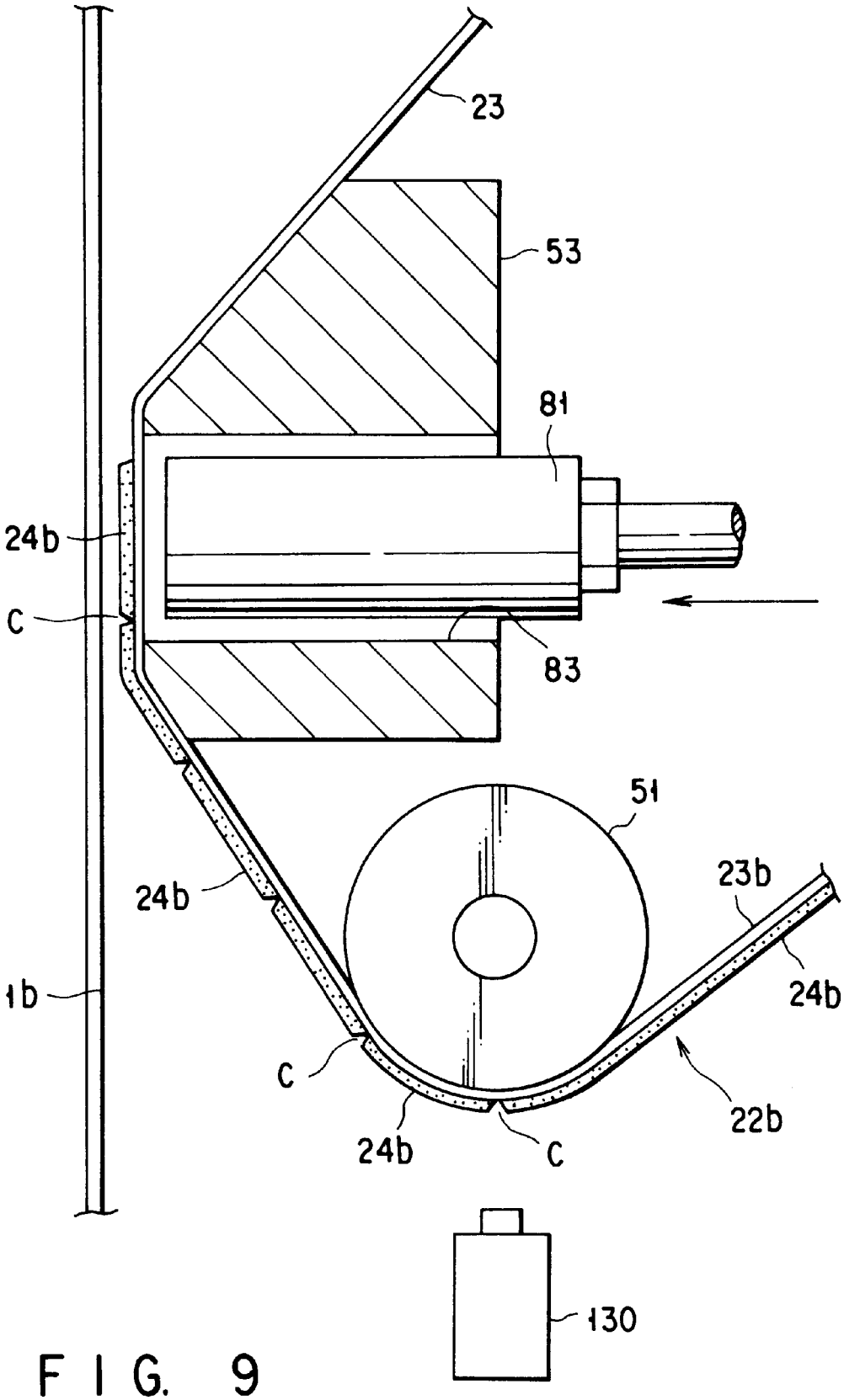
FIG. 9 is a vertical sectional view showing a guide block and a pressing member according to a second embodiment of the invention.

FIGS. 9 and 10 show a second embodiment of the present invention. According to this embodiment, an adhesive tape laminate is formed by sticking precut double-sided adhesive tape pieces of a predetermined length on a seal.

More specifically, an adhesive tape laminate 22*b* used in an apparatus according to this embodiment is formed of a continuous seal 23*b* and a plurality of precut double-sided adhesive tape pieces 24*b* of a predetermined length stuck on the seal, as shown in FIG. 10. For example, the seal 23*b* is wider than the tape pieces 24*a*, and position marks 131 corresponding individually to the respective positions of the stuck tape pieces 24*b* are put on a side margin of the seal. The marks 131 can be detected mechanically, e.g., optically.

The apparatus according to this second embodiment is not provided with the double-sided adhesive tape cutter mechanism that is used in the first embodiment. Instead, the apparatus is furnished with a tape piece position detecting mechanism, which detects the position of each tape piece 24*b* of the delivered adhesive tape laminate 22*b*, as shown in FIG. 9. Numeral 130 denotes a position mark detector of this detecting mechanism. The detector 130 optically detects each position mark 131 on the seal 23*b*, thereby detecting the position of each tape piece 24*b* on the seal.

Based on the detected tape piece position, the tape piece position detecting mechanism controls the operation of the adhesive tape supply mechanism 50, thereby regulating the delivery of the adhesive tape laminate 22*b* so that the tape piece 24*b* concerned stops at a predetermined position relative to the pressing member 81.

After each tape piece 24*b* of the adhesive tape laminate 22*b* stops at the predetermined position, in the apparatus of the second embodiment, as shown in FIG. 9, the pressing member 81 advances to stick the tape piece 24*b* on the web. Since the double-sided adhesive tape used in this embodiment is previously cut into the pieces of the predetermined length, the apparatus never requires the double-sided adhesive tape cutter mechanism or the like, so that it can enjoy a simple construction with high reliability.

Except for the particulars described above, the apparatus according to the second embodiment is constructed in the same manner as the one according to the first embodiment. In the above description of the first and second embodiments, like reference numerals are used to designate like portions throughout the drawings for simplicity of illustration.

The present invention is not limited to the embodiments described herein, and may, for example, be applied generally to apparatuses for sticking adhesive tapes on packing paper and other webs, as well as cigarette paper, tip paper, etc.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An adhesive tape dispensing apparatus for sticking tape pieces coated with an adhesive mass on either side thereof, on a web, said apparatus comprising:

a body reciprocal between a forward position and a rearward position;

an adhesive tape roll comprising a coiled adhesive tape laminate, said adhesive tape laminate being formed of a belt-shaped seal having a first side and a second side and a double sided, tacky, adhesive tape stuck on said first side of the belt-shaped seal;

a holding mechanism, mounted on said body, for rotatably holding said adhesive tape roll;

a delivery mechanism for delivering said adhesive tape laminate from said adhesive tape roll;

a guide mechanism for receiving said adhesive tape laminate, said guide mechanism being fixed to said body, said guide mechanism having a guide member, said guide member having a guide surface adjacent to the web, and said second side of said belt-shaped seal physically contacting said guide surface;

a hole formed in said guide member, said hole opening through a central portion of said guide surface;

a pressing member mounted in said hole, said pressing member being reciprocal relative to said guide mechanism between a first position and a second position, and said pressing member having a generally planar contact surface for contacting said second side of said belt-shaped seal; and a pressing mechanism for momentarily moving said pressing member from its second position to its first position before returning said pressing member to its second position, wherein said first position is characterized by said pressing member protruding from said hole and said guide surface, and said second position is characterized by said pressing member being recessed within said hole beneath said guide surface, said generally planar contact surface contacting said second side of said belt-shaped seal and pressing a piece of said double sided adhesive tape of said adhesive tape laminate against the web when said pressing member is momentarily moved to said first position, while said guide mechanism simultaneously moves with said body to said forward position.

2. The adhesive tape dispensing apparatus according to claim 1, further comprising:

a tape cutter mechanism including a cutting knife, said cutting knife extending in a transverse direction of said adhesive tape laminate and being capable of reciprocation in the transverse direction, said tape cutter mechanism reciprocally pressing said cutting knife against said double-sided adhesive tape of said adhesive tape laminate under a predetermined pressure, to thereby form the tape pieces of said double-sided adhesive tape of a predetermined length, without cutting said belt-shaped seal.

3. The adhesive tape dispensing apparatus according to claim 1, wherein said double-sided adhesive tape includes precut tape pieces, when said adhesive tape laminate exists on said adhesive tape roll, and further comprising:

a tape piece position detecting mechanism for detecting the position of each said tape piece and for controlling the adhesive tape delivery mechanism to selectively locate each said tape piece over said hole formed in said guide surface.

4. The adhesive tape dispensing apparatus according to claim 1, wherein said delivery mechanism includes a pair of pinch rollers arranged downstream of said guide mechanism, said pinch rollers engaging said belt-shaped seal to deliver said adhesive tape laminate from said adhesive tape roll.

5. The adhesive tape dispensing apparatus according to claim 4, further comprising:

a scraper arranged downstream of said guide mechanism and upstream of said pinch rollers, said scraper for engaging said first side of the belt-shaped seal to thereby remove any adhesive mass of the double-sided adhesive tape remaining on said first side of the belt-shape seal.

6. The adhesive tape dispensing apparatus according to claim 4, further comprising:

a seal cutting mechanism arranged downstream of said pinch rollers, said seal cutting mechanism repeatedly, completely severing said belt-shaped seal as lengths of said belt-shaped seal passes thereby.

7. The adhesive tape dispensing apparatus according to claim 6, further comprising:

a container disposed adjacent to said seal cutting mechanism to retain a plurality of severed belt-shape seal portions.

8. The adhesive tape dispensing apparatus according to claim 1, wherein said adhesive tape laminate in said adhesive tape roll is rolled so that said second side of said belt-shaped seal faces radially outside said adhesive tape roll, and wherein said delivery mechanism includes a guide roller adapted to engage said second side of said belt-shaped seal as said adhesive tape laminate is delivered from said adhesive tape roll.

9. The adhesive tape dispensing apparatus according to claim 1, further comprising:

a brake system attached to said body for subjecting said adhesive tape roll to a predetermined rotational resistance to thereby create a predetermined tension in said adhesive tape laminate as said adhesive tape laminate is delivered from said adhesive tape roll.

10. The adhesive tape dispensing apparatus according to claim 1, wherein said pressing mechanism includes a pressing cylinder attached to said body, said pressing member being attached to said pressing cylinder which imparts movement to said pressing member relative to said guide mechanism and said body.

11. The adhesive tape dispensing apparatus according to claim 1, further comprising:

a seal cutting mechanism arranged downstream of said guide mechanism, said seal cutting mechanism repeatedly, completely severing said belt-shaped seal as lengths of said belt-shaped seal passes thereby.

12. The adhesive tape dispensing apparatus according to claim 11, further comprising:

a container disposed adjacent to said seal cutting mechanism to retain a plurality of severed belt-shape seal portions.

13. The adhesive tape dispensing apparatus according to claim 1, further comprising:

a belt-shaped seal roll arranged downstream of said guide mechanism, said belt-shaped seal roll for rolling up said belt-shaped seal.

* * * * *